United States Patent [19]

Miller

[11] Patent Number: 4,561,967

[45] **Date of Patent: * Dec. 31, 1985**

[54] ONE-STEP STABILIZING AND DEWAXING OF LUBE OILS

[75] Inventor: Stephen J. Miller, San Francisco, Calif.

[73] Assignee: Chevron Research Company, San Francisco, Calif.

[ * ] Notice: The portion of the term of this patent subsequent to Jan. 5, 1999 has been disclaimed.

[21] Appl. No.: 562,496

[22] Filed: Dec. 15, 1983

Related U.S. Application Data

[63] Continuation of Ser. No. 256,622, Apr. 23, 1981, abandoned.

[51] Int. Cl.[4] ..... C10G 11/05

[52] U.S. Cl. ..... 208/120; 208/61

[58] Field of Search ..... 208/120, 61

[56] References Cited

U.S. PATENT DOCUMENTS

| | | | |
|---|---|---|---|
| 4,309,275 | 1/1982 | Mulaskey | 208/120 |
| 4,309,276 | 1/1982 | Miller | 208/118 |
| 4,325,805 | 4/1982 | Miller | 208/61 |
| 4,330,396 | 5/1982 | Miller | 208/136 |
| 4,347,121 | 8/1982 | Mayer | 208/61 |
| 4,414,097 | 11/1983 | Chester et al. | 208/61 |
| 4,416,766 | 11/1983 | Mulaskey | 208/120 |
| 4,419,220 | 12/1983 | LaPierre et al. | 208/120 |

*Primary Examiner*—D. E. Gantz
*Assistant Examiner*—Anthony Mc Farlane
*Attorney, Agent, or Firm*—S. R. La Paglia; W. L. Stumpf; V. J. Cavalieri

[57] ABSTRACT

A one-step dewaxing and stabilizing process for hydrocracked lube oils is disclosed wherein said process employs an intermediate pore size zeolite having a high silica-alumina ratio and being free of hydrogenation components and said process being operated at pressures of less than 13 bar.

6 Claims, No Drawings

ONE-STEP STABILIZING AND DEWAXING OF LUBE OILS

This is a continuation of application Ser. No. 256,622 filed Apr. 23, 1981 abandoned.

TECHNICAL FIELD

High quality lubricating oils are critical for the machinery of modern society. Unfortunately, the supply of natural crude oils having good lubricating properties, e.g., Pennsylvania and Arabian light feedstocks is not enough to meet the demand. Additionally, because of uncertainties in world crude oil supplies, it is necessary to be able to produce high quality lubricating oils efficiently from ordinary crude feedstocks.

Numerous processes have been proposed to produce lubricating oils from the ordinary and low quality stocks which ordinarily would be converted into other products. Many of these processes use hydrocracking steps. The problem is that hydrocracked lube oil stocks tend to be unstable in the presence of oxygen and light.

Many of the proposed process schemes involve the use of catalytic dewaxing to lower the pour point of the lube oil stock. Catalytic dewaxing tends to be more efficient than solvent dewaxing since it selectively removes undesirable components from the feed. However, while the product of the extraction step of a solvent dewaxing process tends to be stable to oxygen and to ultraviolet radiation, the product of catalytically dewaxing a hydrocracked feedstock tends to be difficult to stabilize.

In order to achieve the necessary oxidative stability, the typical hydrocracked lube oils stock is subjected to a mild hydrogenation process. The goal of these processes is to hydrogenate the unstable species, thought to be partially saturated polycyclic compounds, while minimizing further cracking and loss of the lube stock. While hydrogenative processes tend to be effective in stabilizing the lube stock to oxidation, it is difficult to avoid some loss of the lube stock by cracking. Additionally, the catalyst used usually contains metallic hydrogenation components such as Group VI and Group VIII metals. A disadvantage to these processes is that hydrogen is consumed. In the petroleum refinery especially, it is preferable to use the hydrogen in processes which produce a significant increase in the value of the product over the reactant, for example, in hydrocracking heavy gas oils as opposed to stabilizing lube stocks.

A number of issued U.S. patents disclose the effect of adding hydrocarbons to various catalytic processes. For example, U.S. Pat. No. 3,214,366, Brennen et al, Oct. 26, 1965, states that hydrocracking can be improved by carrying out the conversion in the presence of $C_3$ to $C_8$ olefins. More recently, U.S. Pat. No. 4,146,465, Blasic et al, Mar. 27, 1979, discloses a process for increasing the octane rating of gasoline and decreasing the quantity of coke produced during catalytic cracking with rare earth faujasites by adding $C_2$ to $C_6$ linear olefins to the feed. Recently issued U.S. Pat. No. 4,206,037, Bousquet et al, June 3, 1980, discloses catalytic hydrodewaxing in the presence of added isobutane using hydrogen form and metal substituted zeolites, including ZSM-5. These background patents, however, do not relate particularly to the problem of stabilizing hydrocracked lube oil stocks to oxidation.

Several additional issued patents relate to stabilizing hydrocracked lube stocks by adding stabilizing agents such as olefins, alcohols, esters or alkylhalides to the lube stock while in the presence of heterogeneous acidic catalysts such as acid resins, clays, and aluminosilicates having controlled alkylation activity. U.S. Pat. No. 3,928,171, Yan et al, Dec. 23, 1975 and U.S. Pat. No. 4,181,597, Yan et al, Jan. 1, 1980. French Pat. No. 2,367,815, Yan, May 12, 1978, discloses a process for stablizing hydrocracked lube oils which have been dewaxed, preferably solvent dewaxed, by contacting them with olefins, preferably $C_6$ to $C_{10}$. The stabilizing catalyst is a heterogeneous, acidic catalyst; the olefins which are not consumed in the reaction are distilled off from the product and combined with other olefins to be added into the stabilizing reaction zone feed. The processes disclosed in these patents, however, have the undesirable requirement that external sources of stabilizing agents, typically the olefins, must be used.

U.S. Pat. No. 3,853,749, Espenscheid et al, Dec. 10, 1974, discloses a process for stabilizing hydrocracked lube oils by contacting a lube oil which contains from 1 to 10% paraffin with a ZSM-5 catalyst. The paraffins may be those present in the undewaxed hydrocracked feed or may be added; the silica-to-alumina ratio is disclosed as ranging from 15 to 200 to 1. Yan et al, General Paper, Division of Petroleum Chemistry, American Chemical Society, August, 1980 Meeting, disclose treating hydrocracked oil over a proprietary shape selective zeolite at high temperatures and in the presence of paraffins.

A number of U.S. patents disclose dewaxing with intermediate pore size zeolites, but not stabilizing the dewaxed feeds. Additionally, many of these patents relate to dewaxing solvent refined lube stocks rather than hydrocracked lube stocks. Among these issued patents are RE-28398 of U.S. Pat. No. 3,700,585, Chen, Oct. 24, 1972; RE-29857 of U.S. Pat. No. 3,790,471, Argauer et al, Feb. 5, 1974. RE-39948 of U.S. Pat. No. 3,941,871, Dwyer et al, Mar. 2, 1976, discloses hydrocarbon conversion reactions with an alumino-organosilicate having a ZSM-5 type X-ray diffraction pattern; U.S. Pat. No. 4,061,724, Grose et al, Dec. 6, 1977, discloses a low aluminum crystalline silica polymorph called "silicalite" which is useful as an adsorbent.

In spite of the large amount of research into developing lubricating oil stocks and stabilizing them, there continues to be intensive research into developing more efficient and more convenient methods for achieving those goals. The object of the present invention is to provide such a convenient and efficient process.

I have discovered that hydrocracked lube oil stock can be dewaxed and stabilized to air and photolytic oxidation without the addition of extraneous chemicals. I have discovered a one-step dewaxing and stabilizing process which is effective in the absence of such diluent gases as nitrogen, and even in the absence of hydrogen. Further, the process produces a high quality lube oil product of low color content.

These advantages are achieved through my discovery that dewaxing the hydrocracked lube stock with a catalyst having an active component consisting essentially of a low aluminum content intermediate pore size zeolite substantially free of hydrogen transfer activity produces a low pour point, high stability, low color, lube stock in good yields.

TECHNICAL DISCLOSURE

The discovery of the present invention is embodied in a lubricating oil dewaxing and stabilizing process comprising catalytically dewaxing and stabilizing a hydrocracked hydrocarbonaceous feedstock by contacting said feedstock in the substantial absence of hydrogen and at low pressure with a catalyst comprising an intermediate pore size zeolite, which has a silica-to-alumina mole ratio of greater than about 200:1 and which is in the hydrogen form, to produce a dewaxed and stabilized effluent of good ultraviolet stability.

The hydrocarbonaceous feeds from which lube oils are made usually contain aromatic compounds as well as normal and branched paraffins of very long chain lengths. These feeds usually boil in the gas oil range. Preferred feedstocks are vacuum gas oils with normal boiling ranges above about 350° C. and below about 600° C., and deasphalted residual oils having normal boiling ranges above about 480° C. and below about 650° C. Reduced topped crude oils, shale oils, liquified coal, coke distillates, flask or thermally cracked oils, atmospheric residua, and other heavy oils can also be used as the feed source.

The hydrocarbonaceous feed is hydrocracked using standard reaction conditions and catalysts. Hydrocracking can take place in one or more reaction zones and with or without initial denitrogenation or desulfurization steps.

Typical hydrocracking process conditions include temperatures in the range of 250° C. to 500° C., pressures in the range of 30 to 205 bar, or more, a hydrogen recycle rate of 100 to 1100 SCM/KL, and a LHSV (v/v/hr) of 0.1 to 50.

Catalysts employed in the hydrocracking zone or zones include those having hydrogenation-dehydrogenation activity, and active cracking supports. The support is often a refractory inorganic oxide such as silica-alumina, silica-alumina-zirconia and silica-alumina-titania composites, acid-treated clays, crystalline aluminosilicate zeolitic molecular sieves (such as Zeolite A, faujasite, Zeolite X and Zeolite Y), and combinations of the above.

Hydrogenation-dehydrogenation components of the hydrocracking catalyst usually comprise metals selected from Group VIII and Group VI-B of the Periodic Table, and compounds including them. Preferred Group VIII components include cobalt and nickel and their oxides and sulfides. Preferred Group VI-B components are the oxides and sulfides of molybdenum and tungsten. Thus, examples of hydrocracking catalysts which are preferred for use in the hydrocracking step are the combinations nickel-tungsten-silica-alumina and nickel-molybdenum-silica-alumina.

A particularly preferred hydrocracking catalyst for use in the present process is nickel sulfide/tungsten sulfide on a silica-alumina base which contains discrete metal phosphate particles (described in U.S. Pat. No. 3,493,517, incorporated herein by reference).

The most preferred feedstocks are those hydrocrackates from which lower viscosity lube oils are produced, and especially those used in preparing light neutral oils having a Saybolt viscosity of less than about 150 S.U.S. (38° C.). Although my process does increase the stability of higher viscosity oils, it is less efficient; stability increases for the lighter grades are dramatic.

The catalytic dewaxing and stabilizinng step of the present invention uses catalysts which contain intermediate pore size zeolites having a silica-to-alumina mole ratio greater than about 200:1 and standard reaction conditions. The intermediate pore size zeolites used in the dewaxing step are zeolites having preferably a silica-to-alumina mole ratio greater than about 500:1 and preferably greater than about 1000:1. In spite of their low aluminum content, these zeolites not only have useful dewaxing activity, but also produce significant amounts of olefins even in the presence of hydrogen and at high pressures. One of the advantages of my process is that the catalyst contains no metal hydrogenation components, thereby simplifying catalyst preparation and eliminating the need for added hydrogen during processing.

By "intermediate pore size" as used herein is meant an effective pore aperture in the range of about 5 to 6.5 Angstroms when the zeolite is in the H-form. Zeolites having pore apertures in this range tend to have unique molecular sieving characteristics. Unlike small pore zeolites such as erionite, they will allow hydrocarbons having some branching into the zeolitic void spaces. Unlike large pore zeolites such as the faujasites, they can differentiate between n-alkanes and slightly branched alkanes on the one hand and larger branched alkanes having, for example, quaternary carbon atoms.

The effective pore size of the zeolites can be measured using standard adsorption techniques and hydrocarbonaceous compounds of known minimum kinetic diameters. See Breck, *Zeolite Molecular Sieves,* 1974 (especially Chapter 8) and Anderson et al, J. Catalysis 58, 114 (1979), both of which are incorporated by reference.

Intermediate pore size zeolites in the H-form will typically admit molecules having kinetic diameters of 5.0 to 6.5 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular zeolite, but do not penetrate as quickly and in some cases are effectively excluded (for example, 2,2-dimethylbutane is excluded from H-ZSM-5). Compounds having kinetic diameters in the range of 6 to 6.5 Angstroms include: cyclohexane (6.0), 2,3-dimethylbutane (6.1), 2,2-dimethylbutane (6.2), m-xylene (6.1), and 1,2,3,4-tetramethylbenzene (6.4). Generally, compounds having kinetic diameters of greater than about 6.5 Angstroms do not penetrate the pore apertures and thus are not absorbed into the interior of the zeolite. Examples of such larger compounds include: o-xylene (6.8), hexamethylbenzene (7.1), 1,3,5-trimethylbenzene (7.5), and tributylamine (8.1).

The preferred effective pore size range is from about 5.3 to about 6.2 Angstroms. ZSM-5 and silicalite, for example, fall within this range.

In performing adsorption measurements to determine pore size, standard techniques are used. It is convenient to consider a particular molecule as excluded if it does not reach at least 95% of its equilibrium adsorption value on the zeolite in less than about 10 minutes ($p/po=0.5$; 25° C.).

Examples of intermediate pore size zeolites include, silicalite, and members of the ZSM series such as ZSM-5, ZSM-11, ZSM-12, ZSM-21, ZSM-23, ZSM-35, and ZSM-38.

Silicalite is described in U.S. Pat. No. 4,061,724; crystalline organosilicates are described in RE-29,948 of U.S. Pat. No. 3,941,871, Dwyer et al, Mar. 2, 1976; ZSM-5 is described in U.S. Pat. Nos. 3,702,886 and 3,770,614; ZSM-11 is described in U.S. Pat. No. 3,709,979; ZSM-12 is described in U.S. Pat. No. 3,832,449; ZSM-21 and ZSM-38 are described in U.S. Pat. No. 3,948,758; ZSM-23 is described in U.S. Pat. No. 4,076,842; and ZSM-35 is described in U.S. Pat. No. 4,016,245. These patents are incorporated herein by reference. The preferred zeolites are low alumina ZSM-5 and ZSM-11, and, silicalite.

The zeolitic catalyst must be substantially free of hydrogen transfer activity such as is conferred by metal hydrogenation components, and high aluminum contents (low silica:alumina mole ratios). If hydrogenation components are present or the silica:alumina ratio is low, the olefins formed in the dewaxing/stabilizing reaction zone tend to be saturated either by residual hydrogen not completely removed from the process stream or by hydrogen transfer from other components of the process stream. Thus, the forms of the intermediate pore size zeolites which are used in the process are the low alumina forms which have high silica:alumina mole ratios of at least 200:1, preferably at least 500:1, and more preferably, at least 1000:1.

Typical dewaxing and stabilizing conditions include an LHSV (v/v/hr) of 0.5 to 200 and a temperature from about 260° C. to 610° C. The process is operated at low pressures, preferably less than about 13 bar (gauge), and more preferably less than about 6.5 bar (gauge). Where the feed to the dewaxing step has a wide boiling range, it is especially preferred to separate it into at least two fractions, where each fraction has a boiling range of greater than about 50° C. When a wide boiling range feed is catalytically dewaxed, the higher boiling portions tend to be underdewaxed while the lower boiling portions tend to be overdewaxed. By splitting the feed to the dewaxing step, the different boiling range fractions can be dewaxed at different severities. After dewaxing, the separate streams can be recombined or processed separately.

As noted above, the dewaxing/stabilization step takes place at low pressures and the feedstock can contain diluent gases other than hydrogen. The unreacted hydrogen in the hydrocracked feedstock can be removed and recycled before performing the dewaxing/stabilization step since the low alumina intermediate pore size zeolites stabilize the lube stock more efficiently in the absence of hydrogen.

The process is preferably operated in the substantial absence of hydrogen and other diluent gases. Typically, as much hydrogen as possible is separated from the hydrocrackate for recycle before the hydrocrackate is introduced to the dewaxing/stabilizing reaction zone.

The preferred method of operation is to operate the dewaxing/stabilizing step at atmospheric pressures and in the substantial absence of hydrogen and diluent gases.

The color test referred to herein is ASTM D-1500 which incorporates a scale of 0.5 to 8.0 in 0.5 increments, with a low color number indicating high transmittance. "Good color" as used herein means an ASTM D-1500 color number of 2.0 or less for light neutral stocks, and of 5.0 or less for medium neutral stocks (>150 S.U.S. at 38° C.).

By "good ultraviolet stability" as used herein is meant that at least about 4 hours will pass in the test described below before an unsatisfactory level of floc appears. Preferably, at least 6 hours will pass. An unsatisfactory level of floc is moderate floc of the level found in mid-continent, solvent refined 100 neutral oil after about 11 hours in the ultraviolet stability test.

The ultraviolet stability of the lube oil is measured by placing the oil samples in glass bottles 16 mm in diameter, 50 mm high and having a wall thickness of about 1 mm. The caps are loosened and the bottles are placed in a circular rack surrounding a 450-watt cylindrical Hanovia Mercury vapor lamp (product of Conrad Precision Industries, Inc.) mounted in a vertical position. The distance along a line perpendicular to the longitudinal axis of the lamp extending from the longitudinal axis of the lamp to the longitudinal axis of the bottle is 2½ inches. The sample is observed over a period of time. At the first appearance of a light fine floc (small particles suspended in the oil), the time to formation of the floc is noted. The additional time until a moderate floc or heavy floc is also noted. In some cases of poor stability, a ring of precipitated particles can be observed during the test clinging to the walls of the bottle. Typically, the test is terminated at 20 hours if no floc appears.

The following feedstocks were used in the Examples.

| | |
|---|---|
| **Feed A** | |
| Light Neutral Oil Feedstock | 54.1 S.U.S. at 50° C. |
| Gravity, °API | 32.5 |
| S, ppm | 4 |
| N, ppm | 1.6 |
| Pour point | 18° C. |
| Vol. %, paraffins | 34.5 |
| naphthenes | 48.7 |
| aromatics | 16.4 |
| Nominal boiling range | 371–427° C. |
| Distillation, (D 1160, °C.): | |
| 5/10 | 367/372 |
| 30/50 | 380/389 |
| 70/90 | 398/413 |
| 95/EP | 420/433 |
| **Feed B** | |
| Medium Neutral Oil Feedstock | 129.7 S.U.S. at 50° C. |
| Gravity, °API | 29.6 |
| S, ppm | 24 |
| N, ppm | 6 |
| Pour point | 38° C. |
| Nominal boiling range | 427–482° C. |
| Distillation, (D 1160, °C.): | |
| 5/10 | 432/436 |
| 30/50 | 446/455 |
| 70/90 | 464/479 |
| 95/EP | 486/496 |
| **Feed C** | |
| 371° C.+ Fractionator Bottoms | |
| Gravity, °API | 34.2 |
| S, ppm | 15 |
| N, ppm | 1.3 |
| Pour point | 27° C. |
| Vol. %, paraffins | 40.5 |
| naphthenes | 48.6 |
| aromatics | 10.7 |
| Distillation, (D 1160, °C.): | |
| 5/10 | 386/387 |
| 30/50 | 391/394 |
| 70/90 | 400/415 |
| 95/EP | 428/451 |

EXAMPLE 1

Experiments were performed to examine the effect of catalytically dewaxing the light neutral feedstock, Feed A, with a high aluminum ZSM-5 catalyst (silica:alumina ratio 80:1). The reaction conditions were controlled to dewax the feed to a pour point of −32° C. and included 0 bar (gauge), LHSV of 0.5, and a temperature in the range of 254° C. to 271° C. The test was first performed using a hydrogen rate of 12 MSCF/bbl and then with no hydrogen added. The product of catalytic dewaxing with the hydrogen had a UV life of 6 hours and a color of <2.0. The product of dewaxing without hydrogen present had a UV life of 16 hours and a color of 4.0.

EXAMPLE 2

An experiment was performed using Feed A to illustrate the benefits of catalytically dewaxing and stabilizing in the same reaction zone using a low aluminum content silicalite-type material having a silica:alumina mole ratio of 216:1. Reaction conditions were controlled to dewax the feed to a pour point of −29° C. and included no hydrogen, LHSV of 2, 0 bar (gauge), and a temperature range of 349° C. to 354° C. The product had a UV life of over 20 hours and a color of less than 1.0.

EXAMPLE 3

An experiment was performed to illustrate the ability of low alumina, intermediate pore size materials to produce lube stocks of good UV stability from heavier feeds. The experiment also illustrates the lower UV lifetimes obtained when the heavier, more viscous medium neutral feed, Feed B, is used. The feed was dewaxed to a pour point of −9° C. using conditions including 0 bar (gauge), no hydrogen, LHSV of 2, and a temperature of 354° C. The product had a UV life of 8 hours.

EXAMPLE 4

An experiment was performed to illustrate that high pressure operation of the one-step dewaxing/stabilizing process is not preferred. Feed C was dewaxed at a pressure of 41 bar (gauge), LHSV of 2, temperature of 396° C., and conversion of 22% (to <371° C.). Although the feed overlapped the nominal boiling range of Feed A, the UV life was only 2 hours.

I claim:

1. A lubricating oil-stabilizing process, comprising:

catalytically stabilizing a hydrocracked lube oil feedstock by contacting said feedstock in the substantial absence of hydrogen and at a pressure of less than about 13 bar with a catalyst which contains no hydrogenation component and which comprises an intermediate pore size zeolite having a silica-to-alumina mole ratio of greater than about 200:1 and being in the hydrogen form, to produce a stabilized light neutral oil of good ultraviolet stability and good color.

2. A process according to claim 1 wherein said intermediate pore size zeolite is selected from ZSM-5, ZSM-11, silicalite, and mixtures thereof.

3. A process according to claim 1 wherein said feedstock is substantially free of diluent gases.

4. A process according to claim 1 wherein the pressure is less than about 6.5 bar.

5. A process according to claim 1 wherein said zeolite has a silica-to-alumina mole ratio greater than about 500:1.

6. A process according to claim 2 wherein said zeolite has a silica-to-alumina mole ratio greater than about 500:1.

* * * * *